US006290387B1

(12) United States Patent
Chen

(10) Patent No.: US 6,290,387 B1
(45) Date of Patent: Sep. 18, 2001

(54) CLOCK SUPPORTED AND MOVABLE ON FLOOR

(76) Inventor: Shun I Chen, P.O. Box 63-99, Taichung (TW), 403

( * ) Notice: Subject to any disclaimer, the term of this patent is extended or adjusted under 35 U.S.C. 154(b) by 0 days.

(21) Appl. No.: 09/620,419

(22) Filed: Jul. 19, 2000

(51) Int. Cl.[7] ..... G04B 37/14
(52) U.S. Cl. ..... 368/317; 368/316
(58) Field of Search ..... 368/248, 276, 368/316, 317

(56) References Cited

U.S. PATENT DOCUMENTS 3,191,901 * 6/1965 Green ..... 368/316
3,727,397 * 4/1973 Ethier ..... 368/276
5,788,608 * 8/1998 Wilkinson ..... 482/51

* cited by examiner

*Primary Examiner*—Andrew H. Hirshfeld
*Assistant Examiner*—Jeanne-Marguerite Goodwin

(57) ABSTRACT

A clock device includes a clock stand, a clock support secured on top of the clock stand, and a clock member secured in the clock support and movable together with the clock support and the clock stand for allowing the clock device to be moved to any required places or positions. The clock stand includes a rod adjustably secured on a tube for adjusting the clock member to various heights. The clock member includes a clock received and secured in a clock housing. The clock housing and the clock may then be secured to the clock support.

1 Claim, 6 Drawing Sheets

CLOCK SUPPORTED AND MOVABLE ON FLOOR

BACKGROUND OF THE INVENTION

1. Field of the Invention

The present invention relates to a clock, and more particularly to a clock assembly for being supported on the floor and for allowing the clock to be easily moved to any required places or positions.

2. Description of the Prior Art

Typical clocks comprise a large volume and may be attached onto the walls. But, the typical clock may not be easily moved to the required places or positions.

The present invention has arisen to mitigate and/or obviate the afore-described disadvantages of the conventional clocks.

SUMMARY OF THE INVENTION

The primary objective of the present invention is to provide a clock assembly which may be supported on the floor and for allowing the clock to be easily moved to any required places or positions.

In accordance with one aspect of the invention, there is provided a clock assembly comprising a clock stand, a clock support secured on top of the clock stand, and a clock apparatus secured in the clock support and movable together with the clock support and the clock stand.

The clock stand includes a base, a tube having a lower end secured on the base and having an upper end, and a rod having a lower portion secured on the upper end of the tube and having an upper portion secured to the clock support.

The tube includes at least one projection extended the lower portion of the rod includes at least one lock channel formed therein for receiving the projection of the tube and for securing the rod to the tube. The lower portion of the rod.

The clock support includes at least one decorative member attached thereon for decorating purposes. The clock apparatus includes a clock housing, a clock body received in the clock housing, and securing means for securing the clock apparatus to the clock support.

The clock support Includes at least one lock ear provided therein, the securing means includes at least one lock bracket attached to the clock apparatus, and at least one fastener engaged with the lock ear and the lock bracket to secure the clock apparatus to the clock support. The clock apparatus further includes a cover attached onto the clock body for shielding the clock body.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
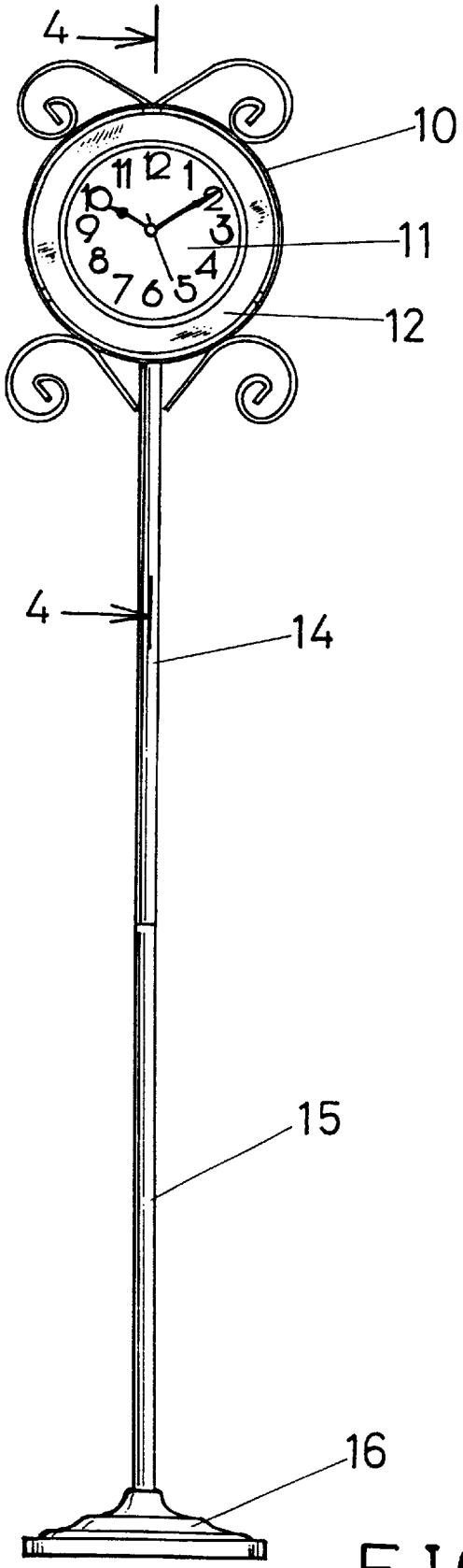
FIG. 1 is a plane view of a clock assembly in accordance with the present invention.
Figure 2:
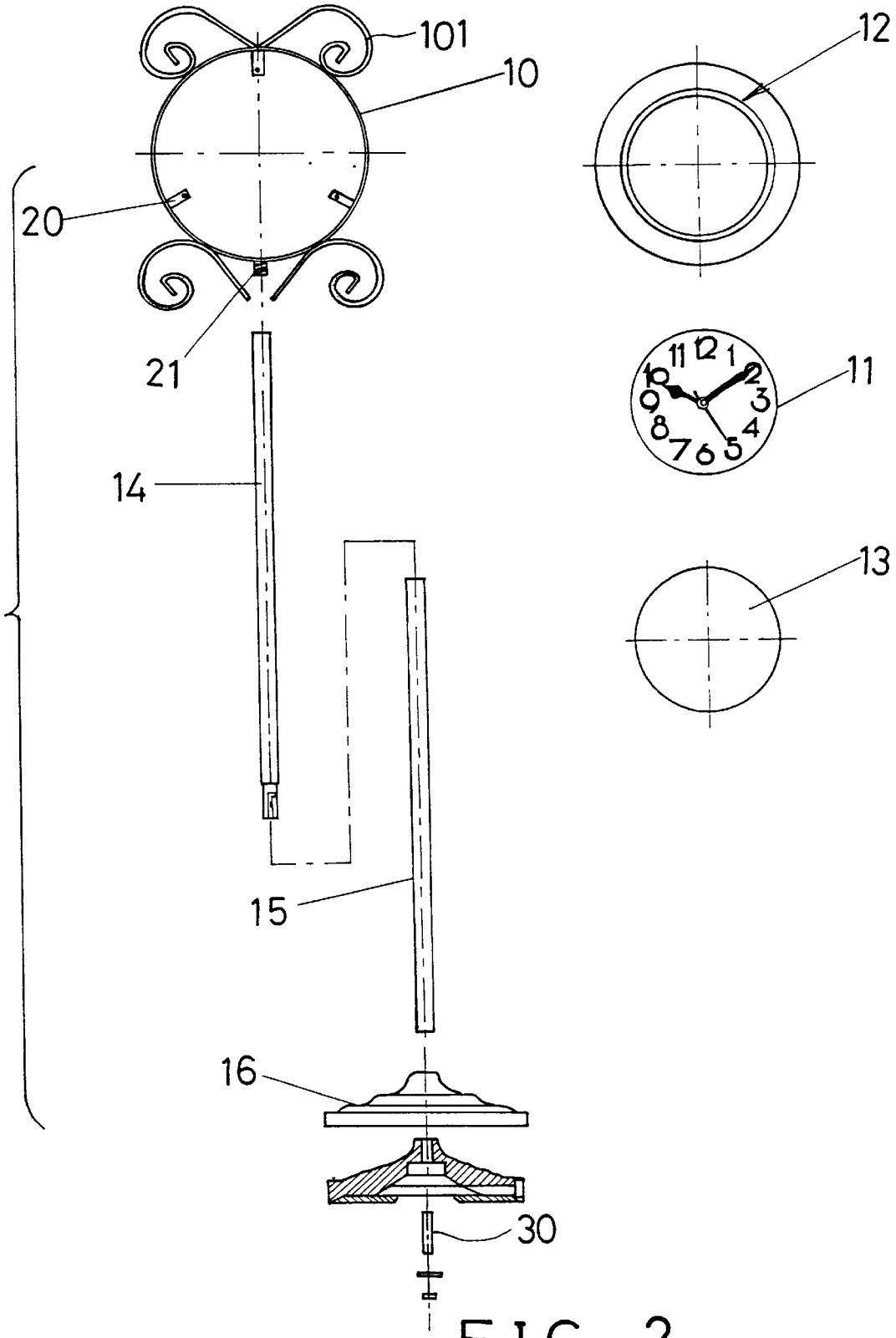
FIG. 2 is an exploded view of the clock support and the clock stand of the clock assembly.
Figure 3:
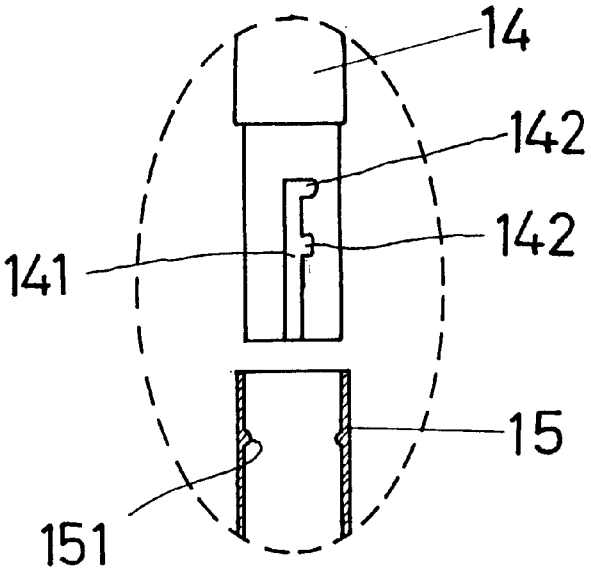
FIG. 3 is a schematic view illustrating the adjustably securing mechanism for the clock stand of the clock assembly.
Figure 6:
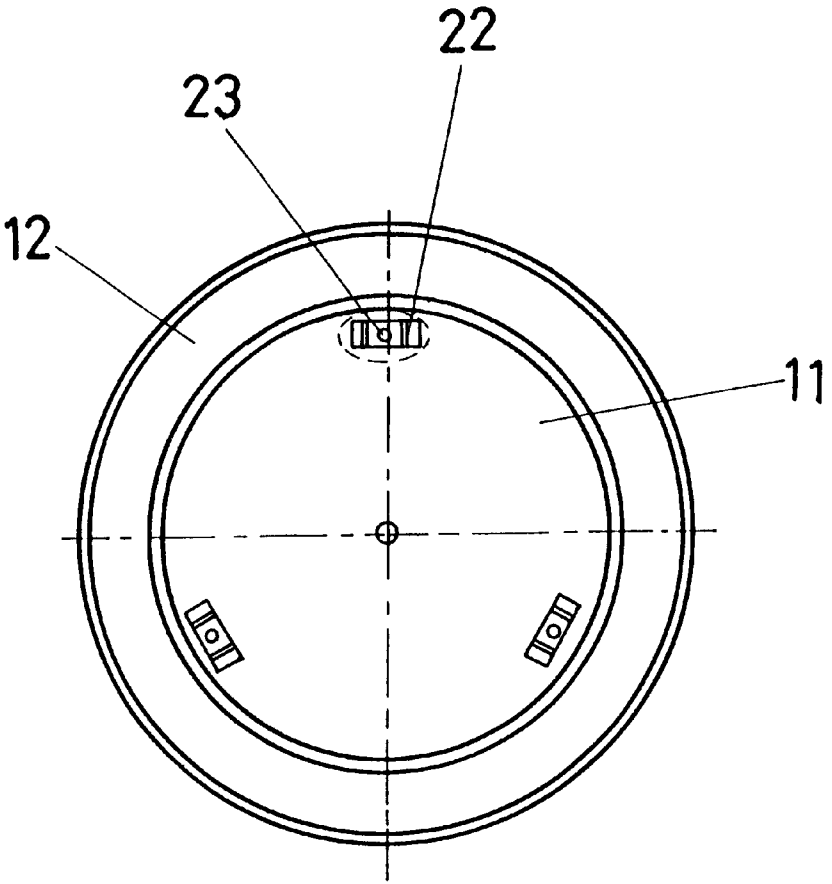
FIG. 6 is a rear view showing the back portion of the clock housing.
Figure 5:
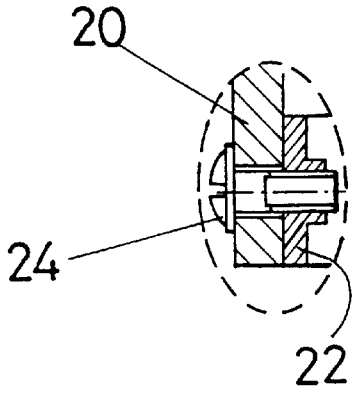
FIG. 5 is an enlarged partial cross sectional view, illustrating the attachment of the clock housing onto the clock support.
Figure 4:
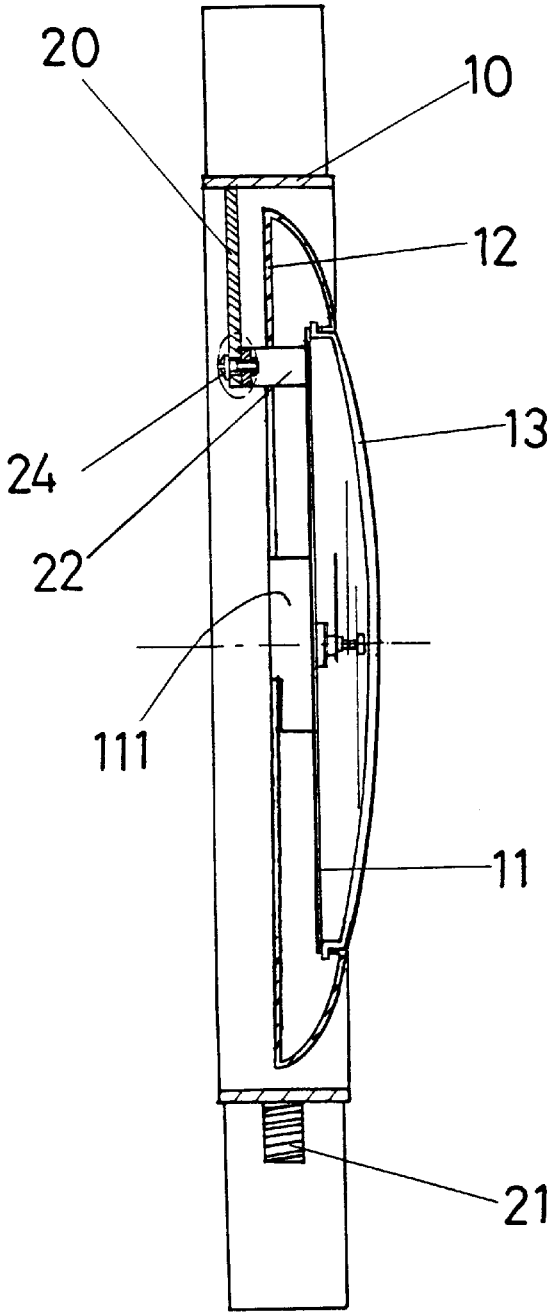
FIG. 4 is a cross sectional view taken along lines 4—4 of FIG. 1.
Figure 8:
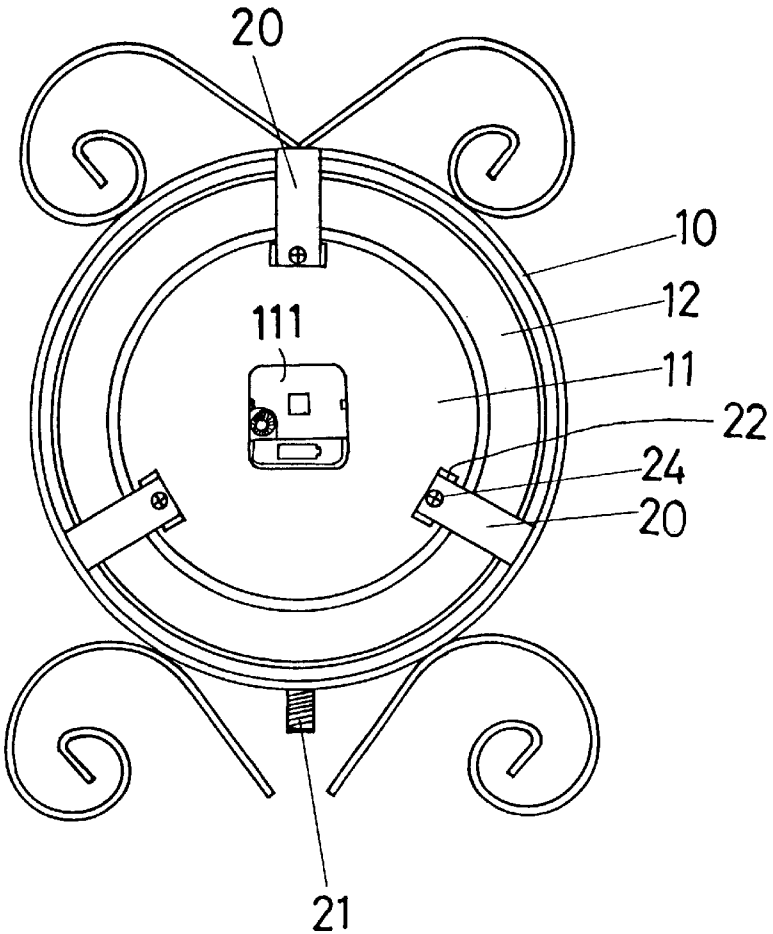
FIG. 8 is a rear view showing the back portion of the clock support, the clock housing and the clock.
Figure 7:
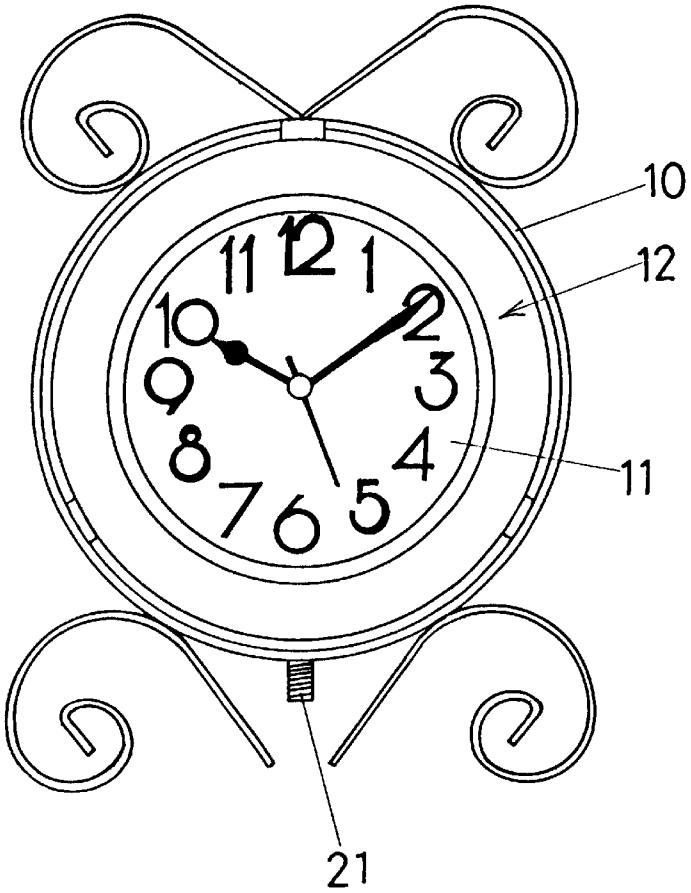
FIG. 7 is a front view showing the front portion of the clock support, the clock housing and the clock.

Referring to the drawings, and initially to FIGS. 1 and 2, a clock assembly in accordance with the present invention comprises a clock stand (14, 15, 16) for supporting a clock support 10 thereon. The clock stand (14, 15, 16) includes a base 16, a tube 15 having a lower portion secured to the base 16 with one or more fasteners 30 and having one or more stops or projections 151 extended inward from the upper portion thereof. As shown in FIGS. 2, 3, the rod 14 includes a lower portion having one or more lock channels 141 formed therein for slidably receiving the projections 151 of the tube 15, and having one or more lock notches 142 formed therein and communicating with the lock channels 141 respectively for receiving the projections 151 of the tube 15 and for adjustably securing the rod 14 to the tube 15 and for allowing the rod 14 to be adjustable up and down relative to the tube 15.

Figure 9:
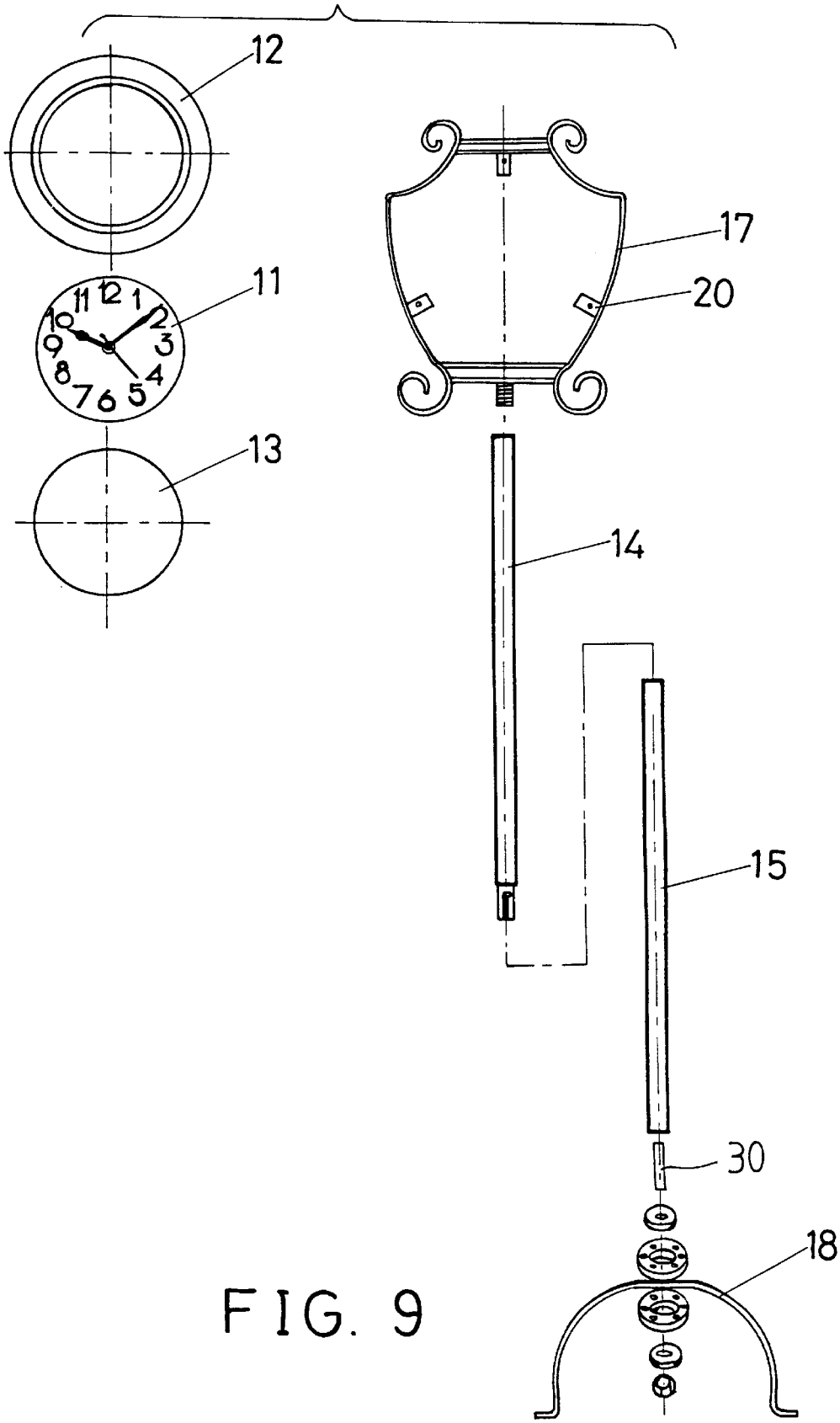
FIG. 9 is an exploded view illustrating the other application of the clock support and of clock stand of the clock assembly.

The clock support 10 is a frame or includes a frame shape having one or more decorative members 101 attached thereon for decorating purposes. The clock support 10 includes one or more lock ears 20 provided on the peripheral portion thereof, and includes a fastener, such as a bolt 21 extended downward therefrom for threading to the upper end of the rod 14, and for detachably securing the clock support 10 on top of the rod 14 of the clock stand (14, 15, 16). As shown in FIG. 9, the clock support 17 and/or the base 18 of the clock stand may be formed with the other shapes for decorating purposes.

As shown in FIGS. 2 and 4–8, a clock apparatus includes a clock body 11 received in a clock housing 12 and secured in the clock housing 12 by such as the clamping latches or by the fasteners. The clock apparatus includes a transparent shield or cover 13 which is attached to the front portion of the clock body 11 for shielding the clock body 11 and which may be clamped or secured between the clock housing 12 and the clock body 11, or which may be secured between the clock housing 12 and the clock body 11 by adhesive materials. The clock body 11 includes a casing 111 provided in the rear portion thereof for receiving one or more batteries therein and/or for receiving the electric elements of the clock therein. The clock housing 12 may include one or more lock brackets 22 attached to the rear portion thereof and each having a screw hole 23 formed therein. One or more fasteners 24 may engage through the lock ears 20 of the clock support 10 and may thread with the screw holes 23 of the lock brackets 22 for locking the clock housing 12 and the clock body 11 to the clock support 10.

The clock body 11 may also be secured in the clock housing 12, but may include a rear portion partially exposed through the rear portion of the clock housing 12, and may include the lock brackets 22 attached to the rear portion thereof for securing the clock body 11 and the clock housing 12 to the clock support 10. Normally, the clock body 11 and the cover 13 are first secured in the clock housing 12 which is then secured to the clock support 10 with the fasteners 24.

In application, casing or the like may be attached onto the rod 14 or the tube 15. Or, alternatively, the rod and/or the tube 15 may include one or more casing provided therein for supporting the other objects, such as the compact discs (CD), etc.

Accordingly, the clock assembly in accordance with the present invention may be supported on the floor and for allowing the clock to be easily moved to any required places or positions.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A clock assembly comprising:

a) a clock stand including:

i) a base;

ii) a tube having a lower end secured on said base and having an upper end;

iii) a rod having a lower portion secured on said upper end of said tube and having an upper portion; and iv) means for adjustably securing said rod to said tube, said adjustably securing means including at least one projection extended inward from said upper end of said tube, and including at least one lock channel formed in said lower portion of said rod for receiving said at least one projection of said tube and for securing said rod to said tube, and including a first lock notch and at least one second lock notch formed in said lower portion of said rod and communicating with said at least one lock channel of said rod for receiving said at least one projection of said tube and for adjustably securing said rod to said tube;

b) a clock support secured on top of said rod of said clock stand, said clock support including at least one decorative member attached thereon for decorating purposes, and said clock support including a peripheral portion having a plurality of lock ears provided therein;

c) a clock apparatus for securing in said clock support and movable together with said clock support and said clock stand, said clock apparatus including a clock housing having a plurality of brackets attached thereto for engaging with said lock ears respectively, and a clock body secured in said clock housing; and d) a plurality of fasteners engaged with said lock ears and said lock brackets to secure said clock housing of said clock apparatus to said clock support.

* * * * *